US005947050A

United States Patent [19]

Eva, III et al.

[11] Patent Number: 5,947,050

[45] **Date of Patent: *Sep. 7, 1999**

[54] FLOATING DRIVE-ON DRY DOCK ASSEMBLY

[75] Inventors: W. Allan Eva, III; David T. Faber, both of Fort Lauderdale, Fla.

[73] Assignee: Ocean Innovations, Inc., Fort Lauderdale, Fla.

[ * ] Notice: This patent is subject to a terminal disclaimer.

[21] Appl. No.: 08/960,422

[22] Filed: Oct. 29, 1997

Related U.S. Application Data

[63] Continuation of application No. 08/667,739, Jun. 21, 1996, Pat. No. 5,682,833, which is a continuation of application No. 08/500,582, Jul. 11, 1995, Pat. No. 5,529,013.

[51] Int. Cl.[6] ..... B63B 35/44

[52] U.S. Cl. ..... 114/263; 114/266

[58] Field of Search ..... 114/263, 266, 114/267, 45, 46, 262, 258, 259; 14/27; 405/219

[56] References Cited

U.S. PATENT DOCUMENTS

| | | | |
|---|---|---|---|
| 1,791,305 | 2/1931 | Gerli . | |
| 2,453,155 | 11/1948 | Nelson et al. . | |
| 2,692,101 | 10/1954 | Doolittle et al. . | |
| 2,742,012 | 4/1956 | Bridges . | |
| 3,734,046 | 5/1973 | Schmidt et al. . | |
| 3,788,254 | 1/1974 | Sheil . | |
| 3,824,644 | 7/1974 | Stranzinger . | |
| 4,604,962 | 8/1986 | Guibault . | |
| 5,529,013 | 6/1996 | Eva, III et al. | 114/263 |
| 5,682,833 | 11/1997 | Eva, III et al. | 114/263 |

*Primary Examiner*—Sherman Basinger

*Attorney, Agent, or Firm*—Renner, Otto, Boisselle & Sklar PLL

[57] ABSTRACT

A floating, drive-on dry dock assembly for a small craft is assembled from two kinds of hollow floatation units, tall units and short units. The units are interconnected so that their top surfaces are substantially coplanar. The units are arranged to form two arms which support the hull of the craft on each side of the longitudinal center line of the craft. The entire length of each arm is made up of tall units except the distal end portions of each arm which may be made up of short units. The short units are able to flex downward as a craft begins to ride up on the dock because of the location of the connection between adjacent units. The tall units, however, cannot flex relative to each other nearly to the same extent as the short units, and so they form a stable generally planar surface. The distal ends of the arms are connected to each other by an upside down short unit. The short units are proportioned so that the uppermost surface of each is out of the water both when the dock is empty and when a craft is "parked" on the dock.

8 Claims, 10 Drawing Sheets

FLOATING DRIVE-ON DRY DOCK ASSEMBLY

This is a continuation of application Ser. No. 08/667,739, filed Jun. 21, 1996 (U.S. Pat. No. 5.682.833 Issued Nov. 4, 1997) which is a continuation of Ser. No. 08/500,582, filed Jul. 11, 1995 (U.S. Pat. No. 5,529,013 Issued Jun. 25, 1996)

FIELD OF THE INVENTION

The present invention relates to floating dry docks and particularly to an improved floating dry dock for small craft including personal watercraft.

BACKGROUND OF THE INVENTION

In the past floating dry docks have been created by the assembly of a number of identical floating subunits. These units have been roughly cubical with tabs projecting from the vertical edges at or near the horizontal midline. By fastening adjacent tabs to each other, a floating dock with a substantially flat deck surface of any desired configuration could be assembled.

Examples of such units and docks assembled from such units are found in U.S. Pat. Nos. 3,824,664 and 4,604,962. These patents describe hollow cubical units which in practice have been manufactured about 16 inches on a side. The units have been molded from a suitable plastic material with the tabs which project from each vertical edge positioned so that a dock of virtually any shape with a flat deck or top surface could be formed. The units have also been provided with bungholes so that the units could be partially flooded to lower the water line of some or all of the units. This has been done particularly where the dock has been used for personal watercraft.

With a personal watercraft, such as a jet ski, or with other small craft, such as a motor boat or jet boat under about 18 feet in length, the goal of the floating dry dock has been to make it possible to drive the craft up onto the dock. This would enable the driver to get on and off the craft without getting in the water and would also permit the craft to be stored out of the water.

Attempts to accomplish these goals have not been entirely successful. The dry docks assembled from prior art units have been either too high above the water to permit a personal watercraft to be driven on, or too low to keep the driver and craft out of the water entirely. Keeping the craft high and dry when not in use is important to protecting the machinery of the craft. In addition, the surfaces of the dock which the craft slides over must be ordinarily above the water line, otherwise marine growths, such as barnacles, will develop and scratch the smooth bottom surface to the craft, doing damage each time the craft slides onto or off of the dock.

The prior art has also included floating units like those shown in the patents identified above, but shorter. These units were about 16 inches square in plan view, but only about 10 inches tall. In addition, in these shorter units the tabs were still about 8 inches down from the deck surface and correspondingly closer to the bottom surface. These shorter units have been thought useful for assembling docks for light watercraft such as the shells used by college crew teams.

SUMMARY OF THE INVENTION

The present invention provides a unique floating drive-on dry dock for personal watercraft or small craft under about 18 feet in length. The dock is assembled from a combination of tall and short hollow, air-tight floatation units. The tall units are roughly cubical and have tabs projecting from about midway along each vertical edge. The short units which have tabs positioned to make a deck continuous with the deck formed by the tall units and which are able to flex downward when a craft is driven onto the dock but which resist flexion in the opposite direction when the craft is in place, to thereby form a rigid, stable surface that can be walked on.

Accordingly, the present invention provides a floating drive-on dry dock formed from a plurality of float units each with a generally flat top or deck surface, the float units being connected together so that their top surfaces form a generally planar and horizontal deck. Each float unit has at least one side wall which faces an opposing side wall on an adjacent float unit. The float units each have a pivotable connection to the adjacent float units, the connections being above the water line when the dock is floating freely and a fixed distance below the deck surface of the float unit. The connections enable adjacent float units to rotate with respect to each other until the respective facing side walls come into contact with each other. A first group of the float units have bottom surfaces located substantially as far below the pivotable connection as their deck surfaces are above the pivotable connection whereby they can rotate downward to the same extent that they can rotate upward before the respective facing side walls come into contact with each other. A second group of float units have bottom surfaces located substantially closer to the pivotable connection whereby they can rotate downward substantially without limitation. The floating drive-on dry dock has a pair of parallel arms formed at least in part of float units from the second group of float units, and there is a bridging unit between the parallel arms, the bridging unit having a top surface which is above the water surface when the dock is floating freely.

The floating drive-on dry dock so constructed has surfaces on which the watercraft slides which are submerged only while the watercraft is being ridden onto the dock, but which remain above the surface both before and after the craft is driven onto the dock. The result is a dock that does not accumulate barnacles or other harmful marine growth. Moreover, the ability of the short units to permit flexion in one direction but not in the other permits them to flex downward while a watercraft is being driven onto the dock and to form a rigid deck once the craft is in place.

DESCRIPTION OF PREFERRED EMBODIMENT

Figure 1:
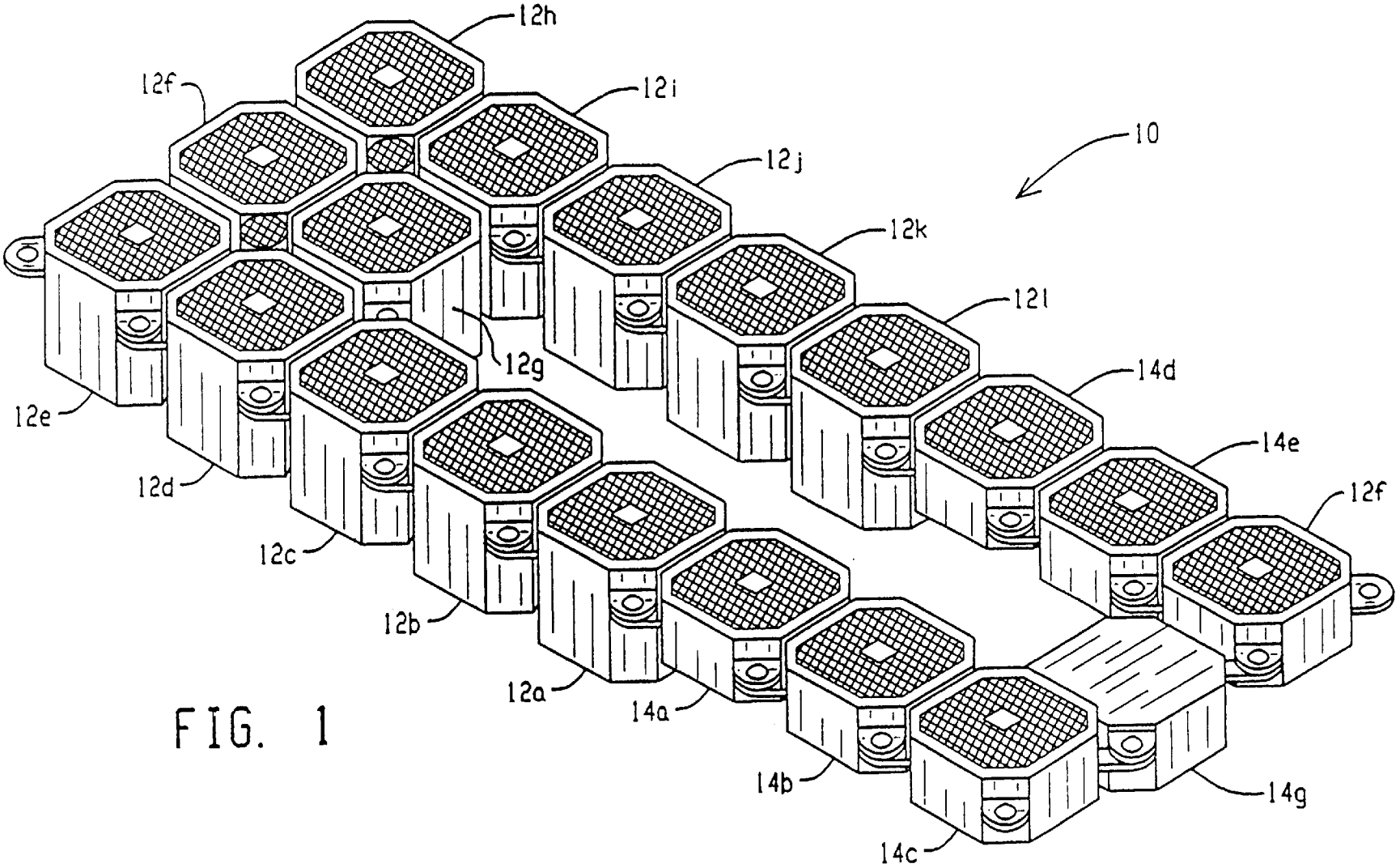
FIG. 1 is a schematic perspective illustration of a dock for a personal watercraft assembled according to the present invention from tall floatation units and from short floatation units.
Figure 2:
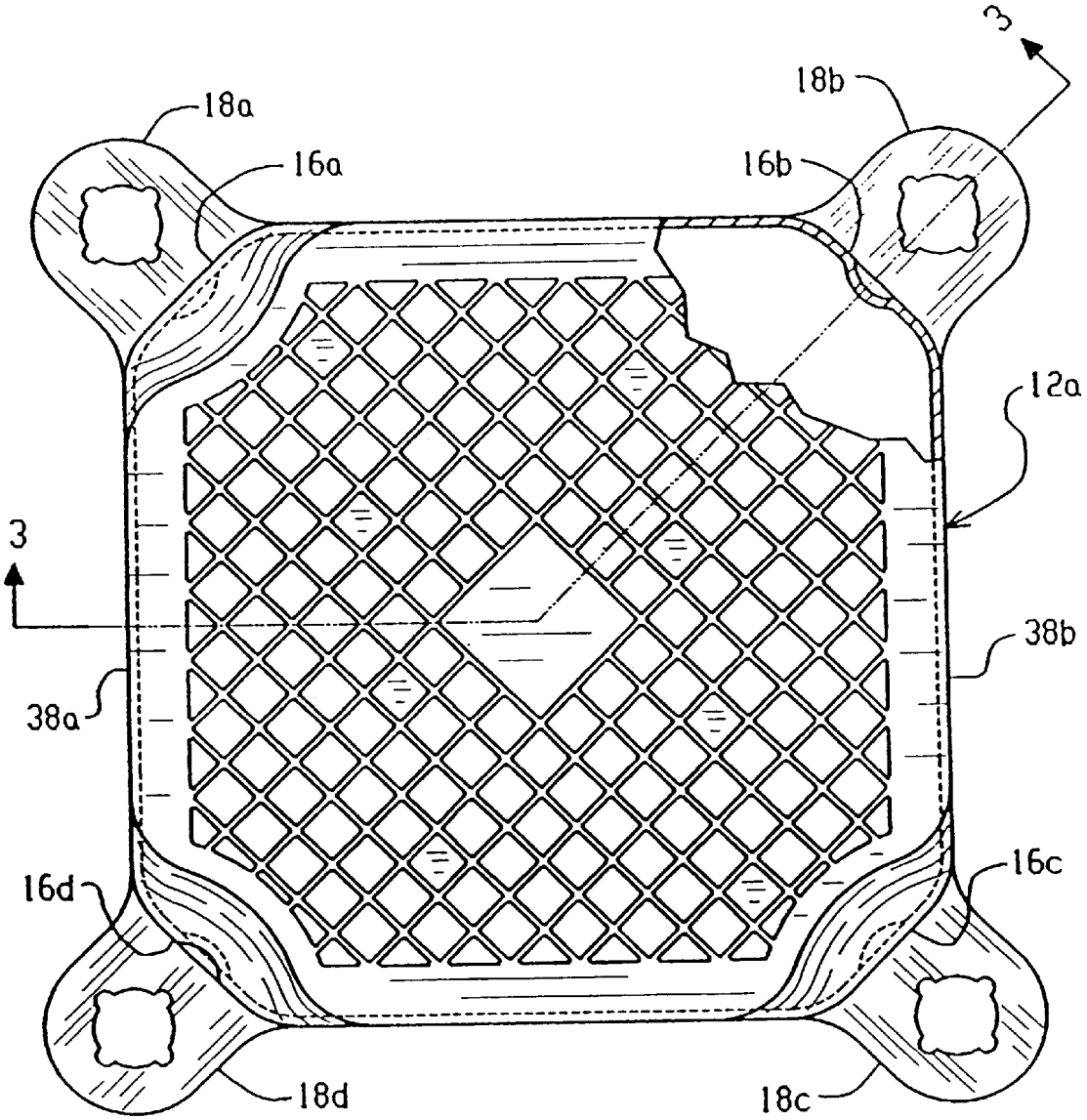
FIG. 2 is a plan view of a tall floatation unit of FIG. 1.
Figure 3:
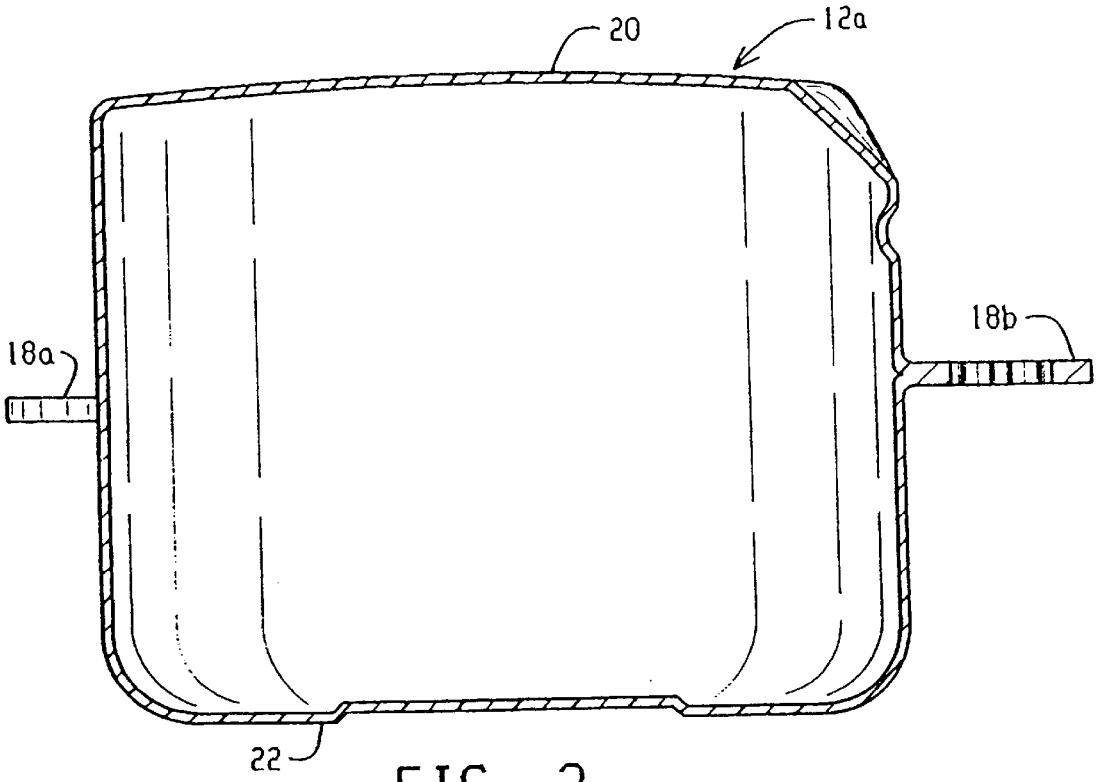
FIG. 3 is a view looking in the direction of arrows 3—3 of FIG. 2.

The dock 10 shown in FIG. 1 is constructed in accordance with the present invention. The dock 10 is formed of identical, tall floatation units 12*a–l* and identical short floatation units 14*a–g*. All of the floatation units 12*a–l* and 14*a–g* are hollow and air-tight. FIGS. 2 and 3 show a plan and vertical section view, respectively through the tall floatation unit 12*a* of FIG. 1. The tall floatation units 12*a–l* are substantially similar to that shown in U.S. Pat. Nos. 3,824,644 and 4,604,962, and the disclosure of these patents is incorporated in its entirety into this application. Because the tall units 12*a–l* are substantially all identical to each other, in this specification the reference numeral 12 without a suffixed letter is used to designate a tall unit generically, while the specific suffixes are used to refer to particular tall units. Similar nomenclature is used in connection with the short units 14*a–g*.

The tall unit 12 (FIGS. 2 and 3) is generally cubical, although the vertical edges 16*a–d* are beveled as shown in FIG. 2. Tabs 18*a–d* project from each beveled edge 16*a–d*, respectively. The tabs, as in the prior art, are vertically staggered to facilitate connecting each floatation unit 12 to its neighbor, as illustrated schematically in FIG. 1.

The tall unit 12 is about 16.25 inches tall from the crown of the top or deck surface 20 to the bottom wall 22. The tall unit is about 19.75 inches on a side in plan view. Thus the tall units 12 are roughly cubical. The tabs 18*a–d* are positioned down from the top or deck surface 20 from about 5.5 inches to about 7.5 inches down from the top surface. By staggering the distance down from the deck surface 20 of the tabs 18*a–d* it is possible to connect the tall floatation units with their deck surfaces 20 approximately coplanar so as to make a deck surface for the floating dock 10 that is more or less flat and without any abrupt steps.

Figure 4:
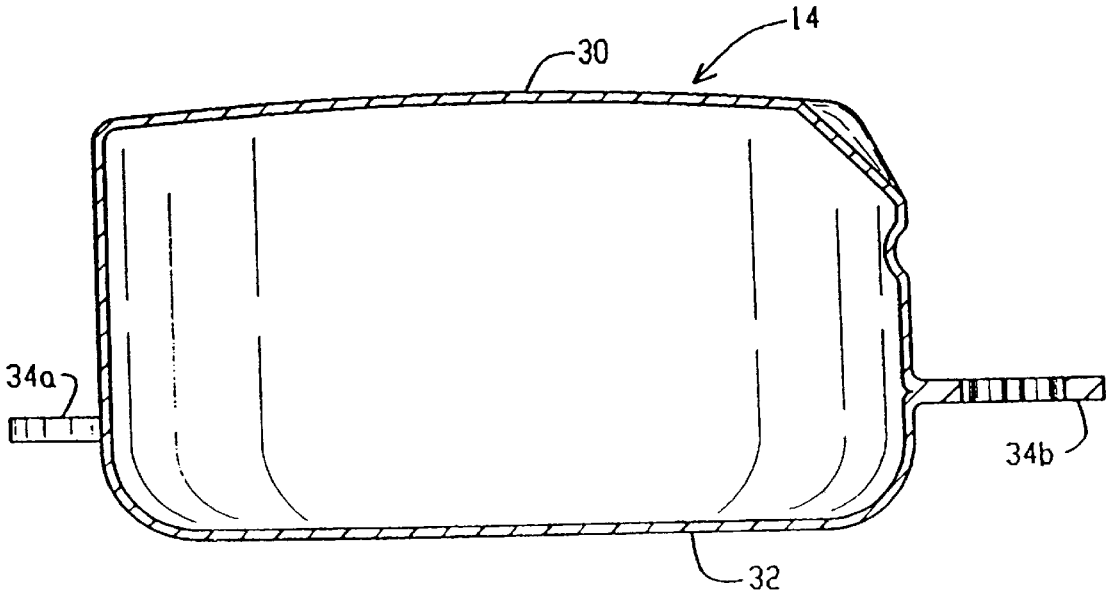
FIG. 4 is a section view similar to FIG. 3, but showing a short floatation unit.

The short floatation units 14 (FIGS. 1 and 4) are similar to the tall units 12 except in the distance from the tabs to the bottom wall. The short floatation units 14 are about 10 inches tall, but have the same plan view layout as the tall units 12. In other words the plan view shown in FIG. 2 of a tall unit 12 is indistinguishable from a similar view of a short floatation unit 14. However, the elevation view, shown in FIG. 4, shows the short floatation units 14 to be approximately 10 inches tall from the crown of their top surfaces 30 to their bottom walls 32. The tabs 34*a–d* (only two shown in FIG. 4) of the short units are identical to the corresponding tabs of the tall floatation units 12, and they are vertically positioned along the beveled corners (not shown) of the short floatation units the same distance down from the top or deck surface 30 as are the corresponding tabs of the tall units. As a consequence of this arrangement, the short units 14 can be interconnected with the tall units 12, and the deck surface produced will be essentially flat and without any abrupt steps.

All the floatation units 12 and 14 are manufactured of High Density Polyethylene (HDPE). This material has proven to be extremely rugged and to resist corrosion as well as the attachment of marine flora and fauna. Moreover, in the sections used HDPE exhibits an appropriate balance between flexibility and stiffness. The tabs 18*a–d* and 34*a–d* are slightly more than one-half inch thick. Each of these tabs has a central opening through which a fastener may be placed. Fasteners and openings like those shown in U.S. Pat. No. 3,824,644 have proved suitable for connecting floatation units 12 and 14 to each other where there are four tabs to be joined. Where three or fewer tabs are to be joined, a plastic nut and bolt assembly 35 (FIG. 5) of conventional design may be used.

When joined together, the floatation units 12 and 14 show some flexibility relative to one another. This is a desirable feature in an object such as a dock that will be subject to a variety of forces from people walking on it to watercraft being driven on it to tides and storms. Some flexibility enhances the life of the structure over a completely stiff structure.

Figure 5:
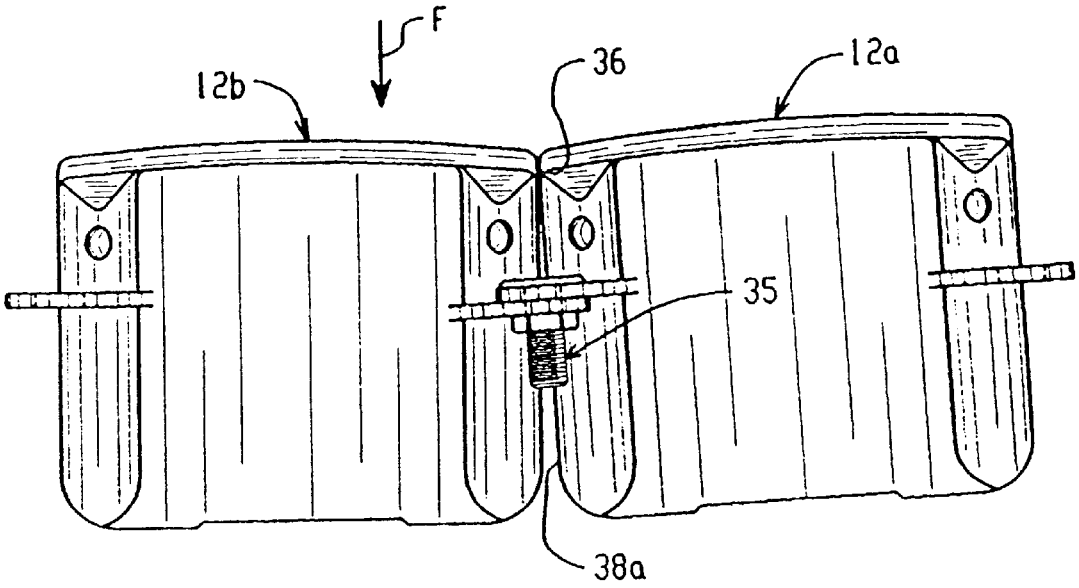
FIG. 5 is a schematic illustration of two tall floatation units flexed by a downward force, F, to bring their top corners into contact.
Figure 6:
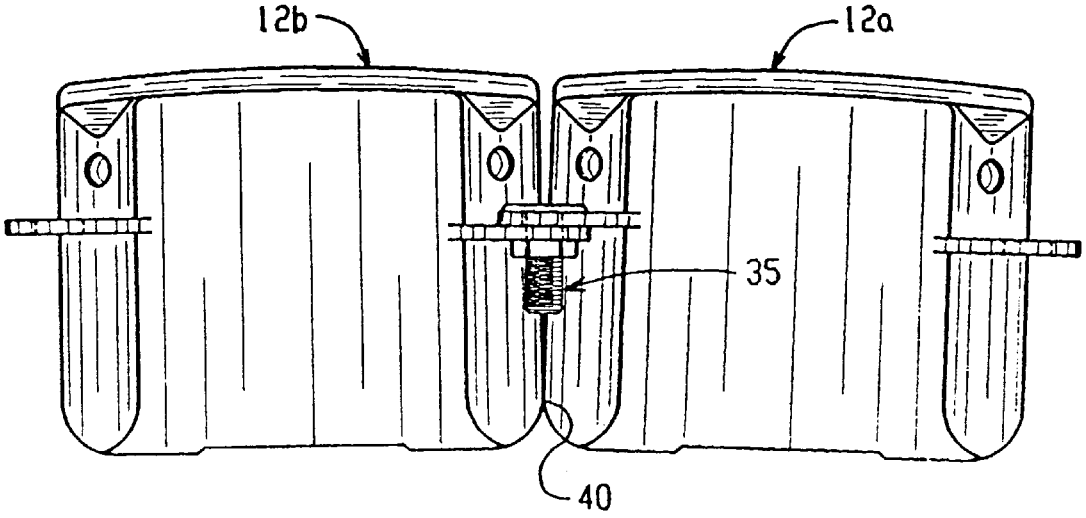
FIG. 6 is a view similar to FIG. 5, showing the same tall floatation units flexed in the opposite direction to bring their bottom corners into contact.

The position of the tabs 18*a–d* relative to the deck surface 20 and bottom wall 22 limit the amount of flexion that two tall floatation units 12 can exhibit relative to each other. As shown, for example in FIG. 5, adjacent tall units 12*a* and 12*b* are fastened to each other by the tabs which are located at about the horizontal midline of the tall floatation units 12. When, for example, a force F is applied to floatation unit 12*b* tending to rotate it clockwise around the tabs, the top corners of units 12*a* and 12*b* are pressed together, as shown at 36 in FIG. 5 and relative pivoting movement is substantially limited. Rotation of no more than a few degrees is permitted before the top corners come into contact as shown at 36 in FIG. 5. Similarly rotation in the opposite direction is limited by contact of the bottom corners as shown in FIG. 6 at 40. Again, only a few degrees of rotation is possible before contact between the bottom corners.

Figure 7:
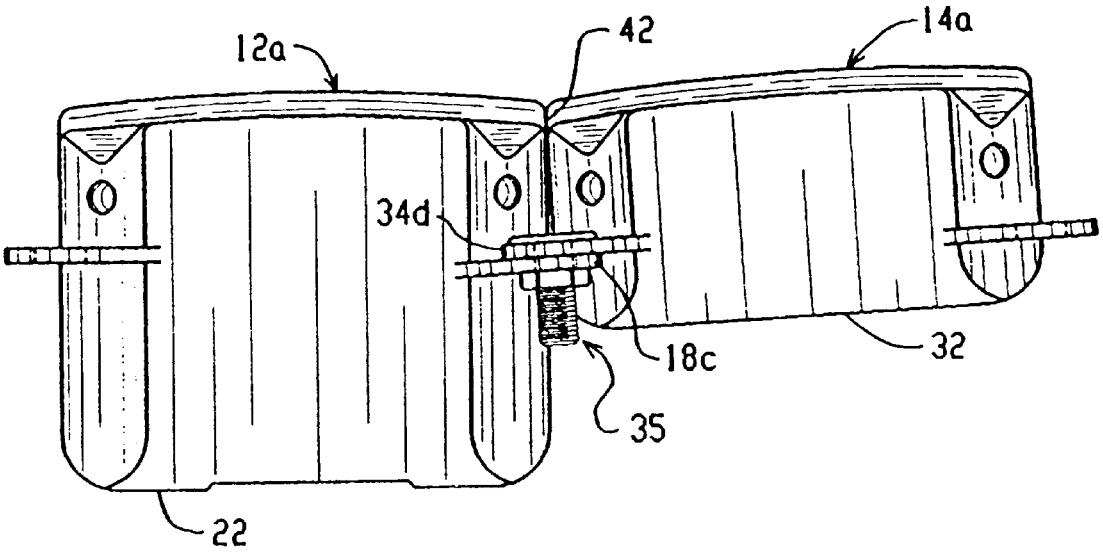
FIG. 7 is a schematic view of a tall floatation unit connected to a short floatation unit and showing the units flexed to bring their top corners into contact.
Figure 8:
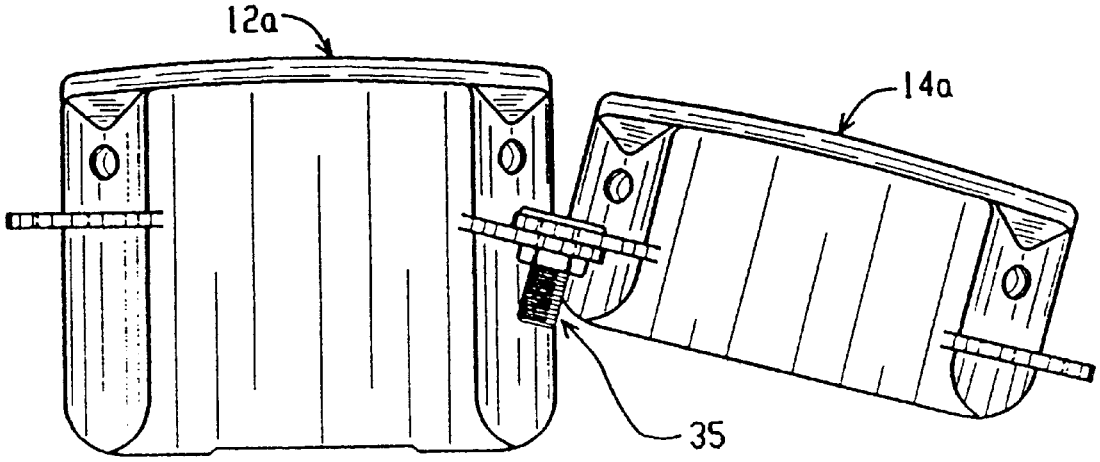
FIG. 8 is a view similar to FIG. 7 but showing the short unit flexing away from the tall unit.

The connection between a short floatation unit 14 and a tall unit 12 (FIGS. 7 and 8) or between two short units 14 results in different permitted motion. The tabs 34*a–d* are much closer to the bottom surface 32 of the short unit 14 than are the corresponding tabs of the units 12. Therefore, the short units 14 can flex substantially in one direction, while flexion in the opposite direction is limited the same as for the tall floatation units 12. For example, as illustrated in FIG. 7, the short floatation unit 14*a* is connected to the tall floatation unit 12*a* by suitable fasteners 35 joining tabs 18*b* and *c* of the tall unit with tabs 34*a* and *d* of the short unit, respectively. The short floatation unit 14*a* is free to rotate clockwise around the tabbed connection as shown in FIG. 8 because of the flexibility of the tabs and their location near the bottom 32 of the short floatation unit. However, rotation of the short unit 14*a* in the counterclockwise direction is limited by contact between the top corners of the short and tall units as shown at 42. Depending on the amount of force applied, the short unit 14*a* can rotate in a clockwise sense (as viewed in FIG. 8) as much as 10°–15°. When two short units are connected to each other the permitted motion is slightly greater.

The asymmetry of permitted bending permits a unique dock to be assembled using both short and tall floatation units. As illustrated in FIGS. 1 and 11–14, a dock 10 for a personal watercraft (e.g., a jet ski) is assembled from both short floatation units 14 and tall floatation units 12. A row of three tall units 12*e, f*, and *h* (FIG. 9), are closest to the shore or a permanent conventional dock (not shown). Outward from them is another row consisting of tall units 12*d, g*, and *i*. Together the six tall units 12*d–i* form a rectangular base 50.

Two arms 52 and 54 extend from the base 50. The arm 52 is formed of tall units 12*c*, 12*b*, and 12*a* followed by short units 14*a*, 14*b*, and 14*c* in that order. See FIG. 9. The arm 54 is composed of tall units 12*j*, 12*k*, and 12*l* followed by short units 14*d*, 14*e*, and 14*f*.

Figure 9:
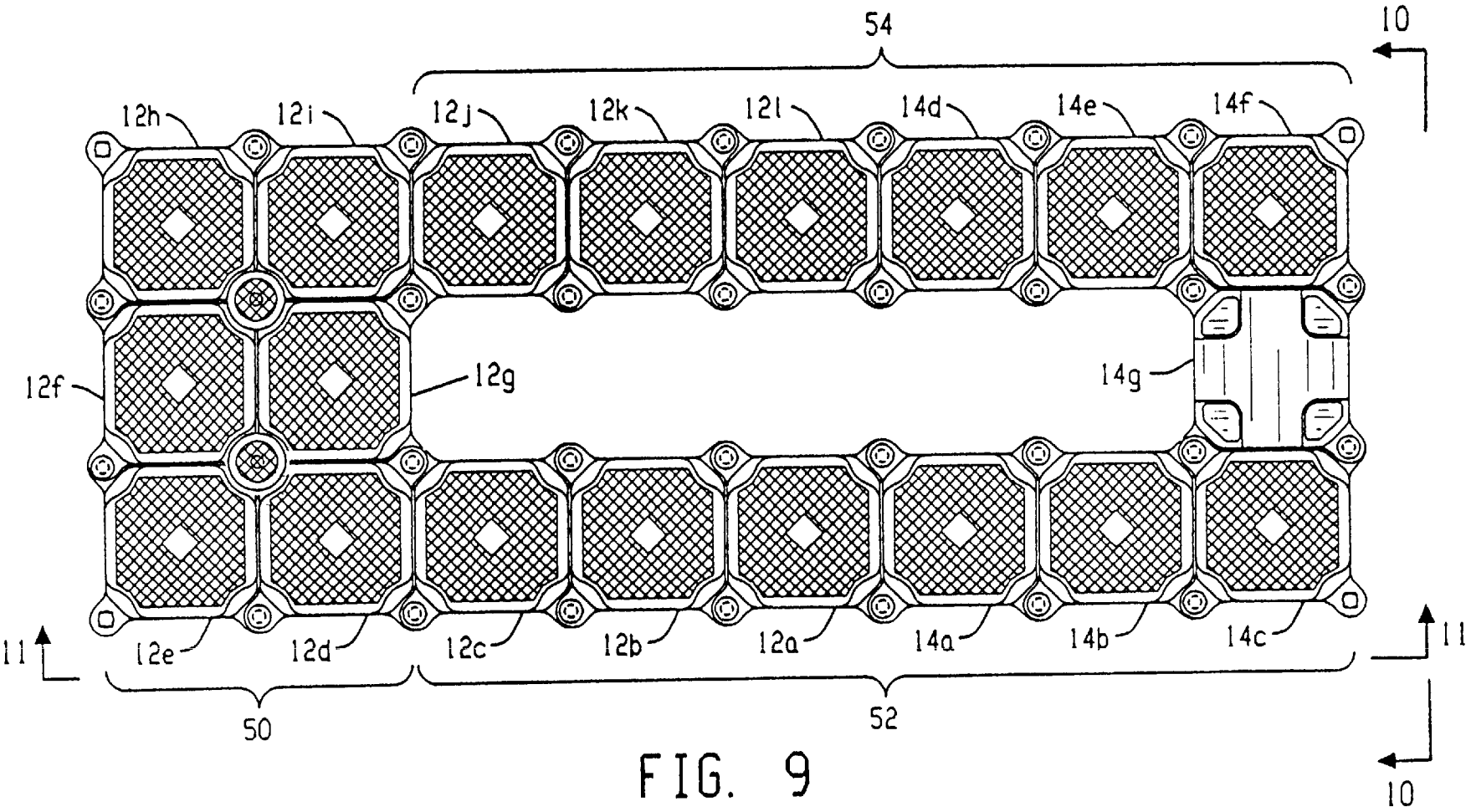
FIG. 9 is a plan view of the dock of FIG. 1.
Figure 10:
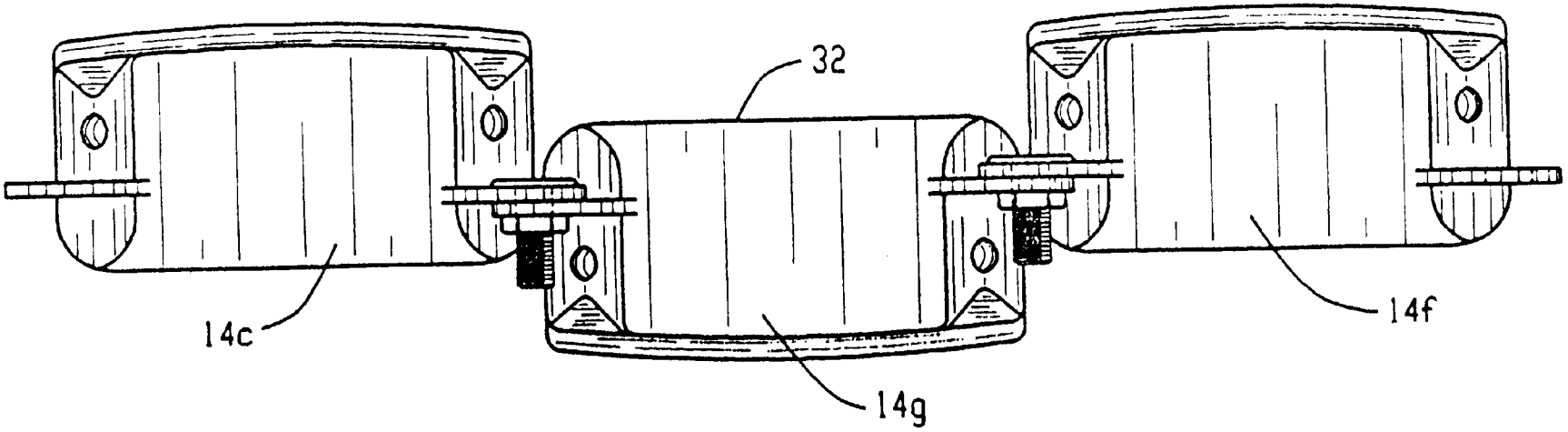
FIG. 10 is a view looking in the direction of arrows 10—10 of FIG. 9.
Figure 11:
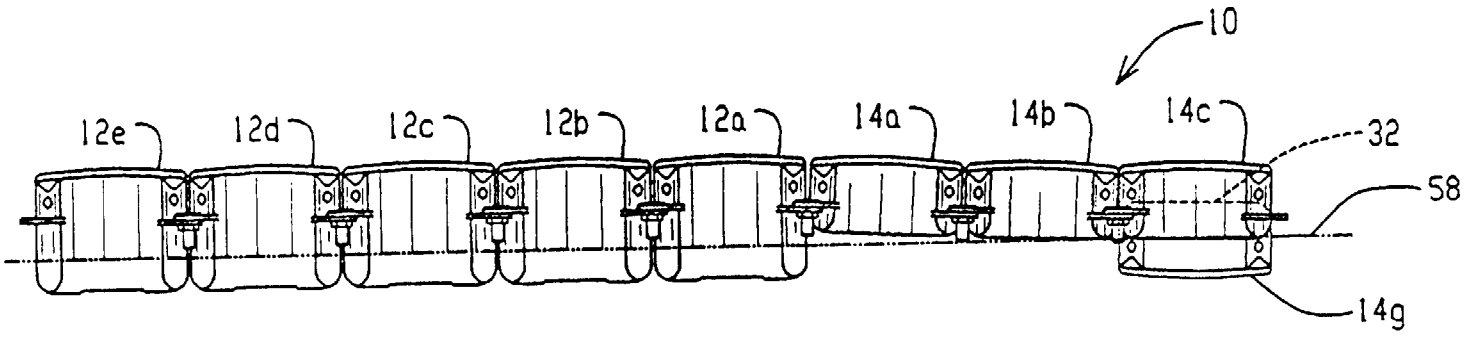
FIG. 11 is a view looking in the direction of arrows 11—11 of FIG. 9 showing the dock in the water and unloaded.
Figure 14:
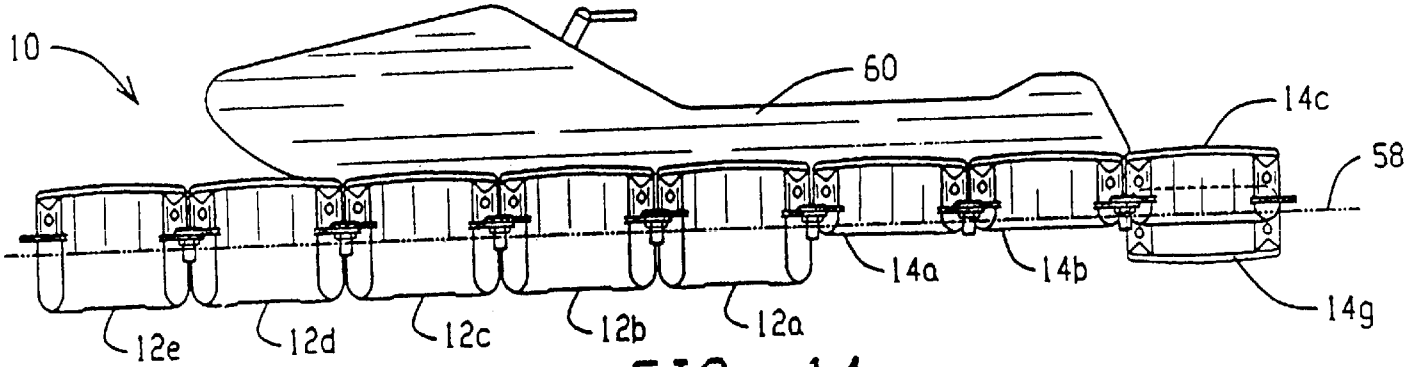
FIG. 14 is a view generally like FIG. 12, but showing the craft in place on the dock.

The distal ends of arms 52 and 54 are connected to each other by an inverted or upside down short unit 14*g* (FIGS. 9 and 10). The short unit 14*g* connects the units 14*c* and 14*f* which form the ends of the arms 52 and 54, respectively, and keep the arms from splaying outward when a craft is driven between them. The short units 14 are proportioned so that the surface 32 of unit 14*g* (the "bottom surface" when the unit 14*g* is right side up) is above the water level 58 when the dock 10 is floating unloaded (FIG. 11) and when it is loaded (FIG. 14). This results in a surface 32 of the inverted short unit 14*g* that is free of marine growth that might scratch or otherwise damage the bottom of a personal watercraft.

Figure 15:
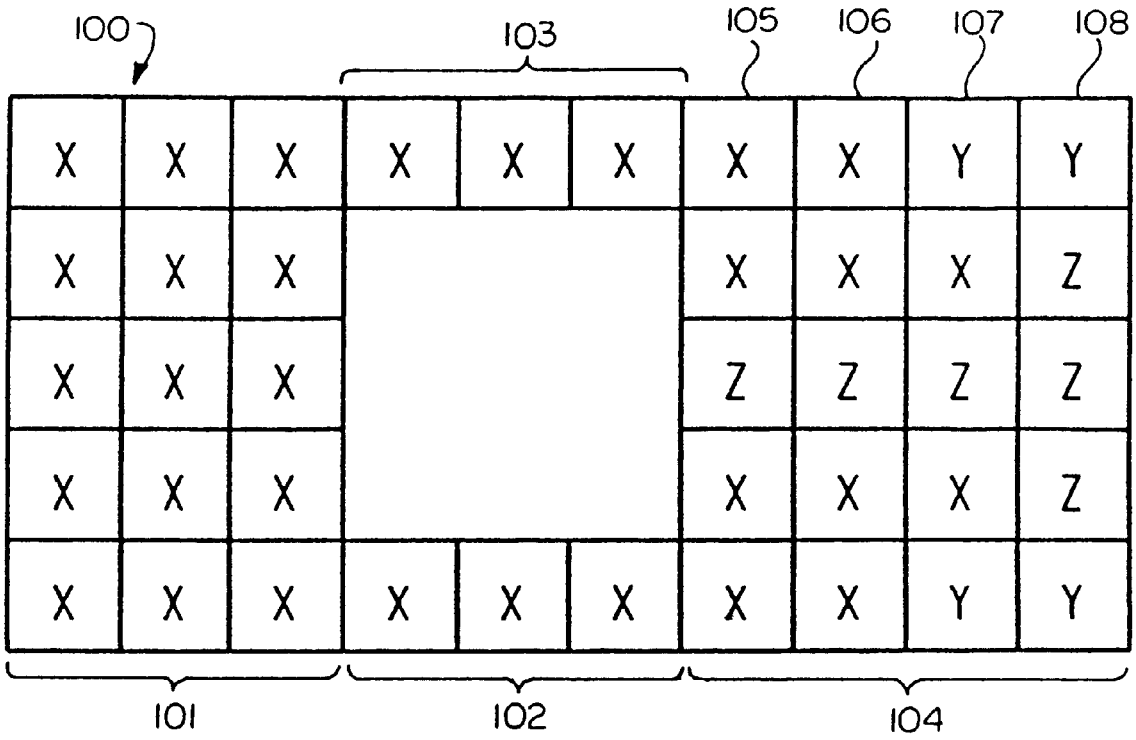
FIG. 15 is a schematic plan view of a dock assembled according to the present invention for a small craft such as a jet boat.
Figure 16:
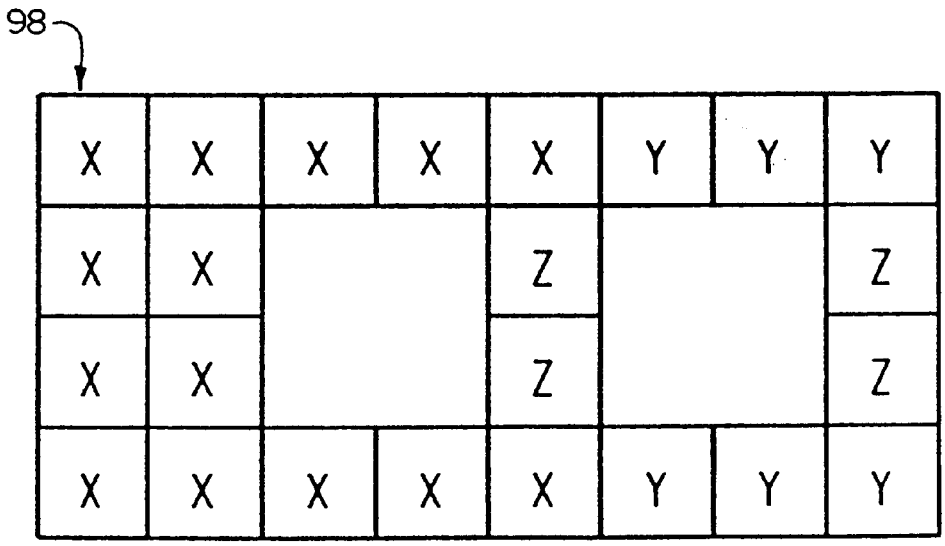
FIG. 16 is a view similar to FIG. 16, but showing a dock assembled for yet a different craft.

It will be understood that the dock 10 is illustrative only, and that other configurations are possible to accommodate different sizes and types of craft. For example, docks may be assembled for use with jet boats, outboard motor boats, sailboats with centerboards, and small craft generally, namely craft under about 18 feet in length. Moreover, docks may be assembled with slips for two or more watercraft without departing from the scope of the invention. By way of example FIGS. 15 and 16 show different docks that can be assembled from the tall flotation units 12 and the short flotation units 14. In FIGS. 15 and 16, plan views of docks are shown, with the tall units being indicated by squares marked "x", the short units being indicated by "y", and the inverted short units being indicated by squares with the letter "z". The dock 100 illustrated in FIG. 15 may be especially suited for a craft such as a jet boat, up to about 18 feet in length. The dock 98 in FIG. 16 is more suitable for a somewhat smaller craft.

Figure 12:
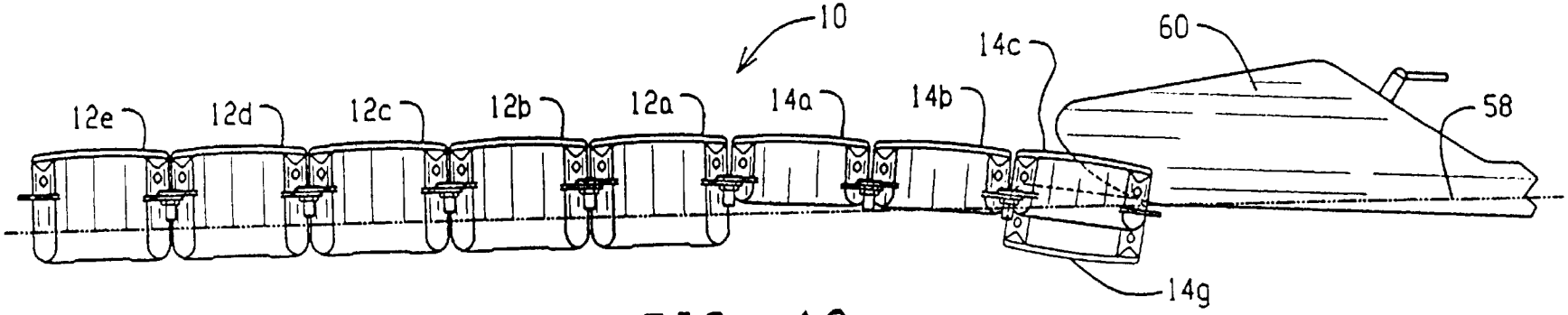
FIG. 12 is a view generally similar to FIG. 11 but showing a craft approaching the dock and the downward flexion of the short floatation units.
Figure 13:
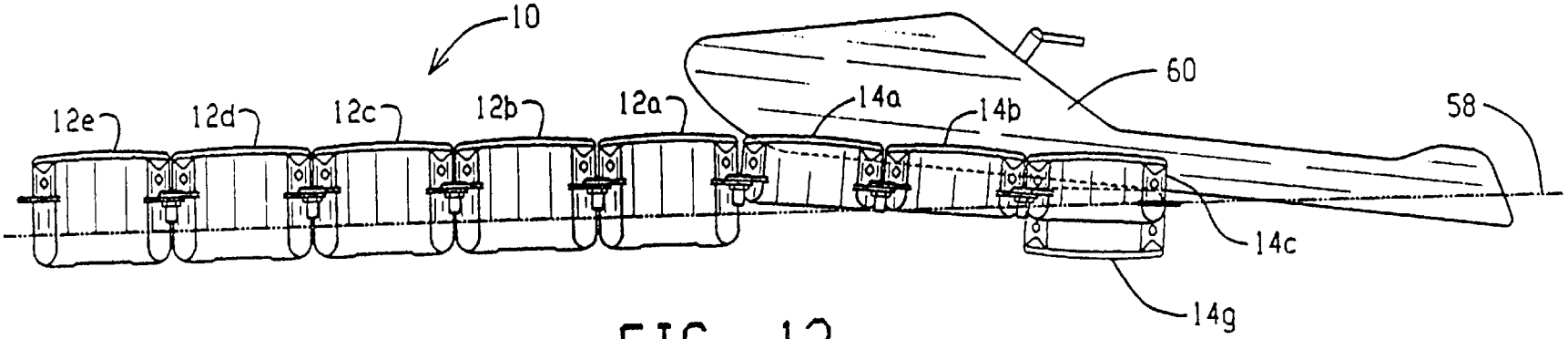
FIG. 13 is a view generally like FIG. 12 but showing the craft partially on the dock.

In use, a watercraft 60 may be ridden onto the dock 10. This is done by centering the craft between the arms 52 and 54 with the keel of the craft on the surface 32 of the inverted short unit 14*g*, as shown in FIG. 12. Then a short burst of power is applied to the craft 60 by gunning its engine. The craft 60 moves forward (FIG. 13), and its momentum carries it to its rest position (FIG. 14). During this process the short units 14*a–c* and 14*d–f* flex downward as the weight of the craft is imposed initially on the distal ends of arms 52 and 54, as shown in FIG. 13. The connection between the short units 14 illustrated in FIG. 8 makes this possible because the short units are initially forced to flex in a clockwise direction as viewed in the Figures. However, as motion of the craft 60 proceeds, the forces applied tend to rotate the floatation units 12 and 14 in the opposite direction, bringing the top corners of the units into contact and limiting the rotation motion, as shown in FIGS. 5 and 14.

The craft 60, once it is on the dock 10, is completely out of the water and is supported by the two arms 52 and 54 which support the hull of the craft on opposite sides of its keel. Thus the craft is stabilized against rocking movement. At the same time the weight of the craft supplies a downward force tending to press the top corners of the floatation units 12 and 14 together so that the dock 10 becomes essentially rigid.

The dock 100 illustrated in FIG. 15 operates in a slightly different manner than those illustrated in the other Figures. Specifically, because jet boats are significantly heavier than personal water craft such as jet skis, additional buoyancy is necessary. Accordingly, the dock 100 includes a bow portion 101 formed of tall floatation units 12 connected together as discussed above. The bow portion is five units wide. Two arms 102 and 103 extend toward the stern and are each formed from three tall floatation units in series. The stern portion 104 of the dock is formed of four rows of floatation units, with five units in each row. In rows 105 and 106, all the floatation units are tall units 12, except the center one in each row, which is an inverted short unit 14. In the next row 107 again the center unit is an inverted short unit 14. A tall unit 12 is located on each side of the central, inverted short unit 14 and a short unit is located on the end of each row, this time right side up. The final row 108 of the stern portion 104 is assembled entirely from short units 14, with the center three being inverted. The arrangement shown in FIG. 15 defines a broad flat deck formed from the top surfaces of all the floatation units except the inverted short units, marked "z". The inverted units, "z", define a lowered center portion to receive and guide the keel of the craft into place on the dock. The surrounding tall floatation units, "x", provide the bouyancy necessary to support the jet craft high and dry when it is on the dock, while the short units, "y", in rows 107 and 108 reduce the bouyancy enough to allow the stern portion 104 to be depressed as the craft is driven onto the dock 100.

Thus it is clear that the present invention provides a unique floating, drive-on dry dock 10 for a small watercraft such as a personal watercraft 60. The dock 10 is assembled from a combination of tall floatation units 12 and short floatation units 14. The tall units 12 are roughly cubical and have tabs 18*a–d* projecting from about midway along each vertical edge. The short units 14 have tabs 34*a–d* positioned to make a deck continuous with the deck formed by the tall units 12 and which are able to flex downward when the craft 60 is driven onto the dock 10 but which resist flexion in the opposite direction when the craft is in place, to therefore form a rigid, stable surface that can be walked on.

Accordingly, the present invention provides a floating, drive-on dry dock 10 formed from a plurality of float units each with a generally flat top or deck surface, the float units being connected together so that their top surfaces 20, 30 form a generally planar and horizontal deck. Each float unit 12, 14 has at least one side wall, e.g., 38*a*, 38*b*, which faces an opposing side wall on an adjacent float unit. The float units each have a pivotable connection to the adjacent float units, the connections being above the water line 58 when the dock is floating freely and a fixed distance below the deck surface of the float unit. The connections enable adjacent float units 12, 14 to rotate with respect to each other until the respective facing side walls come into contact with each other. A first group of the float units, the tall units 12, have bottom surfaces 22 located substantially as far below the pivotable connection as their deck surfaces 20 are above the pivotable connection whereby they can rotate downward to the same extent that they can rotate upward before the respective facing side walls come into contact with each other, as shown in FIGS. 5 and 6.

A second group of float units, the short units 14, have bottom surfaces 32 located substantially closer to the pivotable connection whereby they can rotate downward substantially without limitation as shown in FIG. 8. The floating dock 10 has a pair of parallel arms 52 and 54 formed at least in part of float units from the second group of float units, and there is a bridging unit 14*g* between the parallel arms, the bridging unit having a top surface 32 which is above the water surface 58 when the dock 10 is floating freely.

The floating, drive-on dry dock 10 so constructed has surfaces on which the watercraft 60 slides which are submerged only while the watercraft is being ridden onto the dock, but which remain above the surface both before and after the craft is driven onto the dock. The result is a dock 10 that does not accumulate barnacles or other harmful marine growth. Moreover, the ability of the short units 14 to permit flexion in one direction but not in the other permits them to flex downward while a watercraft is being driven onto the dock and to form a rigid deck once the craft is in place.

In a further aspect of the present invention, a dock 10, 98, or 100 (FIGS. 1, 15 and 16) is formed a number of interconnectable floatation units. The units are arranged so that the dock has a generally planar deck defining a bow end portion, a pair of arms leading toward the stern from the bow end portion and a guide portion connected between the arms having a top surface below that of the deck for receiving and guiding the keel of a boat.

What is claimed is:

1. A floating dock assembly for a water craft having a hull, said assembly comprising a plurality of floatation units connected to each other to form a base and a pair of arms extending axially from the base, the units of the base and the arms being connected to each other for relative pivoting movement and spaced apart to contact and support the hull of the craft on opposite sides of the axial centerline of the craft when the craft is on the dock, and at least one member between the arms, the lowest point of the hull of the craft resting on the member when the craft is on the dock, the floatation units of the arms being closed and hollow to provide buoyancy and having generally planar uppermost top surfaces defining a common generally horizontal plane, and the member having a top surface positioned below the common plane.

2. The dock assembly of claim 1 including a plurality of members connected between the arms.

3. A floating dock assembly adapted to receive a water craft driven lengthwise onto the floating dock assembly from the water and for supporting the water craft above the surface of the water, the assembly comprising at least three floatation units having sufficient total buoyancy to support the craft above the water's surface when the craft is on the dock assembly, the units being connected to each other in series with connections that flex about at least two axes which are transverse to the direction of the water craft, and the floatation units defining a guiding surface to engage the bottom of the water craft, the guiding surface having a non-linear contour when viewed looking lengthwise of the assembly to guide the water craft lengthwise as it is driven onto the dock.

4. The assembly of claim 3 wherein the guiding surface extends lengthwise of the dock assembly and transverse to the axis about which the units flex.

5. The assembly of claim 4 adapted to receive a craft having a keel extending in a stem to stern direction, and the guiding surface positioned to engage the keel of the craft and the guiding surface extending at least part of the length of the assembly.

6. A floating dock assembly adapted to receive a water craft driven lengthwise onto the floating dock assembly from the water and for supporting the water craft above the surface of the water, the assembly comprising at least three floatation units having sufficient total buoyancy to support the craft above the water's surface when the craft is on the dock assembly, the units being connected to each other in series with connections that flex about at least two axes which are transverse to the direction of the water craft, and the floatation units defining a guiding surface to engage the bottom of the water craft and contoured to guide the water craft lengthwise as it is driven onto the dock, the guiding surface extending lengthwise of the dock assembly transverse to the axis about which the units flex, the units having generally flat top surfaces which lie in a common horizontal plane and the guiding surface being a surface disposed below the horizontal plane defined by the units.

7. The assembly of claim 6 wherein the connections between units include portions of adjacent units which overlap each other.

8. The assembly of claim 7 wherein the connections include pins which extend through the overlapping portions of adjacent units.

* * * * *